US005306394A

United States Patent [19]

Meinander

[11] Patent Number: 5,306,394

[45] Date of Patent: Apr. 26, 1994

[54] TURBULENCE ROLL FOR A WEB FORMER

[75] Inventor: Paul O. Meinander, Grankulla, Finland

[73] Assignee: A. Ahlstrom Corporation, Noormarkku, Finland

[21] Appl. No.: 961,675

[22] PCT Filed: Jul. 5, 1990

[86] PCT No.: PCT/F191/00177

§ 371 Date: Jan. 5, 1993

§ 102(e) Date: Jan. 5, 1993

[87] PCT Pub. No.: WO92/01110

PCT Pub. Date: Jan. 23, 1992

[51] Int. Cl.[5] ..... D21F 1/20; D21F 1/40

[52] U.S. Cl. ..... 162/209; 162/355; 162/356; 492/36

[58] Field of Search ..... 162/209, 355, 356, 351, 162/211, 354, 357, 368, 372; 492/36, 39

[56] References Cited

U.S. PATENT DOCUMENTS

| | | | |
|---|---|---|---|
| 1,629,088 | 5/1927 | Aldrich | 162/342 |
| 1,988,402 | 1/1935 | Thomas | 167/357 |
| 2,092,798 | 9/1937 | Charlton | 162/356 |
| 2,263,440 | 11/1941 | Hansen | 492/36 |
| 2,722,164 | 11/1955 | Duncan | 162/342 |
| 2,787,913 | 4/1957 | Hageline | 492/36 |
| 2,860,557 | 11/1958 | Corbin | 162/342 |
| 3,577,315 | 5/1971 | Franklin | 162/372 |
| 3,913,240 | 10/1975 | Flamig | 162/357 |
| 4,048,008 | 9/1977 | Skrabak et al. | 162/342 |
| 4,306,934 | 12/1981 | Seppanen | 162/300 |

FOREIGN PATENT DOCUMENTS

| | | | |
|---|---|---|---|
| 187711 | 7/1907 | Fed. Rep. of Germany | 162/356 |
| 353600 | 5/1922 | Fed. Rep. of Germany | 492/36 |
| 1379124 | 3/1988 | U.S.S.R. | 492/36 |
| 745573 | 2/1956 | United Kingdom | 492/36 |

*Primary Examiner*—Karen M. Hastings

*Attorney, Agent, or Firm*—Cohen, Pontani, Lieberman, Pavane

[57] ABSTRACT

A turbulence roll for a web former. The roll generates high frequency small-scale vibration in the stock on the forming fabric whereby fluidization of the partially formed fiber mat and dispersion of fiber flocs in the stock is brought about. The turbulence roll is formed of a shaft on which a plurality of discs (32) is disposed a distance apart from each other and a plurality of lengthwise extending rods (34) is attached to the rims of the discs and spaced apart from each other.

3 Claims, 3 Drawing Sheets

TURBULENCE ROLL FOR A WEB FORMER

FIELD OF THE INVENTION

The present invention relates to a turbulence roll for generating high-frequency vibration of a forming fabric so as to create fine-scale turbulence into the stock on the forming fabric. The turbulence roll according to the invention can be used in the production of fiber webs such as paper, board and non-woven webs and is particularly suitable for use in multilayer filter paper machines comprising an inclined wire portion in which dilute stocks are dewatered.

BACKGROUND OF THE INVENTION

It is known that the formation can be improved by causing high-frequency small-scale vibration in the fiber suspension on a forming fabric by means of a roll having longitudinal grooves, disposed under the forming fabric, whereby dispersion of fiber flocs is brought about.

In turbulence rolls having a grooved surface such as those described in the German patent application 1611761, the fabric on the roll will move towards the roll center every time a groove passes under the fabric. The displacement of the wire and the frequency of the oscillations caused by the roll depend on the gap of the grooves, the roll diameter and the rotational speed of the roll. The oscillation of the wire keeps the partially formed mat fluidized so that it dewaters more readily, redisperses the stock forming into flocs and prevents sealing of the fabric. It also causes dewatering to a certain degree by means of the repeated pumping action of the fabric against the stock and the mat.

In web formers using dilute stock in which large amounts of water have to be removed through the forming fabric, the flow resistance of the drainage and supporting means should be low. This means that normally rolls cannot be used immediately after the headbox. At high speeds, the land area between the grooves produces pressure pulses detrimental to the sheet quality. Therefore, static elements such as foils must be used. In certain applications, however, for instance in web formers having a curved drainage zone, static elements cause considerable frictional forces and increase the tension of the wire wherefor a rotating roll would be preferred.

The object of the present invention is to provide an improved turbulence roll which can be used in various types of web formers and which is particularly well adapted to be used in a multilayer filter paper machine having an inclined wire portion the inclination of which is gradually decreasing.

Other objects, features and advantages of the invention will be readily apparent from the following description of a representative embodiment thereof, taken in conjunction with the accompanying drawing although variations and modifications may be effected without departing from the spirit and scope of the novel concept embodied in the following detailed description of the invention.

SUMMARY OF THE INVENTION

It is a characteristic feature of the turbulence roll according to the present invention that the roll is formed of a shaft on which a plurality of discs is disposed at a distance from each other and a plurality of lengthwise extending rods is attached to the rims of the discs and spaced apart from each other.

According to a preferred embodiment of the invention, the turbulence roll is used as a supporting roll between two flat sections, forming an angle with each other in the inclined wire portion of a filter paper machine. It is clear that the turbulence roll according to the invention can also be used in the horizontal wire portion.

BRIEF DESCRIPTION OF THE DRAWINGS

In the following description, by way of example, reference will be made to the accompanying drawings, in which.

DETAILED DESCRIPTION OF THE PRESENT PREFERRED EMBODIMENTS

Figure 1:
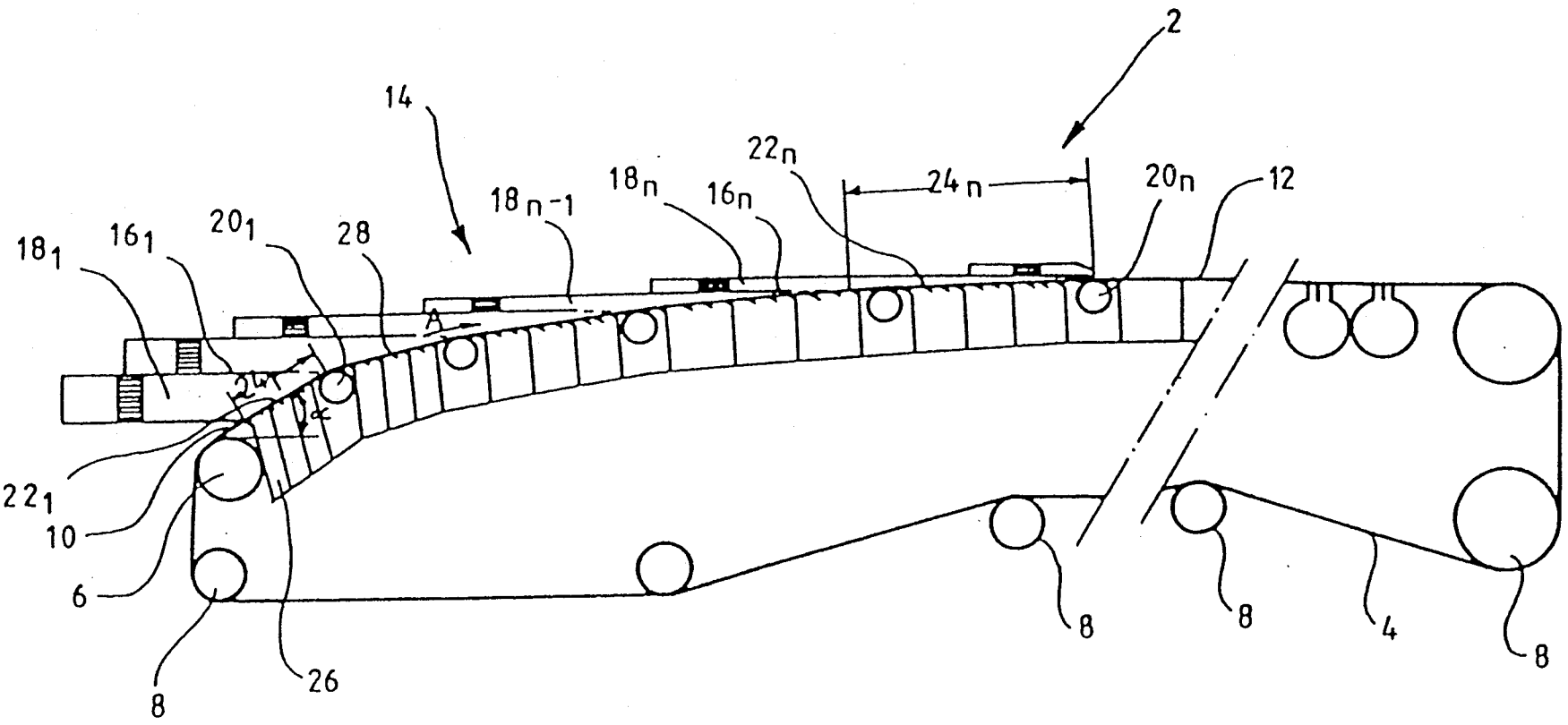
FIG. 1 is a schematic elevational sectional view showing a former for use in the practice of the present invention.

FIG. 1 illustrates a web former 2 adapted for producing a multilayered filter paper. It comprises a forming fabric such as a wire 4 running in an endless loop around a breast roll 6 and a plurality of return rolls, guide rolls and stretch rolls 8 in a manner known per se. The wire comprises an inclined wire portion 10 and a horizontal or substantially horizontal wire portion 12. A headbox 14 is by means of partition walls $\mathbf{16}_1$–$\mathbf{16}_n$ divided into individual flow channels $\mathbf{18}_1$–$\mathbf{18}_n$ facing the inclined wire.

Each flow channel has an upper wall and a lower wall and the upper wall or lip $\mathbf{16}_n$ of one channel $\mathbf{18}_{n-1}$ forms the lower wall or lip of the flow channel $\mathbf{18}_n$ on top of it.

The inclined wire portion is supported by a plurality of drainage rolls $\mathbf{20}_1$–$\mathbf{20}_n$, which define a plurality of flat forming zones $\mathbf{22}_1$–$\mathbf{22}_n$ the inclination angle $\alpha$ of which decreases in the traveling direction A of the wire. The location and length of each forming zone corresponds generally to the location and length of the portion $\mathbf{24}_1$–$\mathbf{24}_n$ of the wire on which fibers from a flow channel $\mathbf{18}_1$– $\mathbf{18}_n$ are deposited. Thus, each flow channel leads to a flat forming zone having a different inclination angle.

Figure 2:
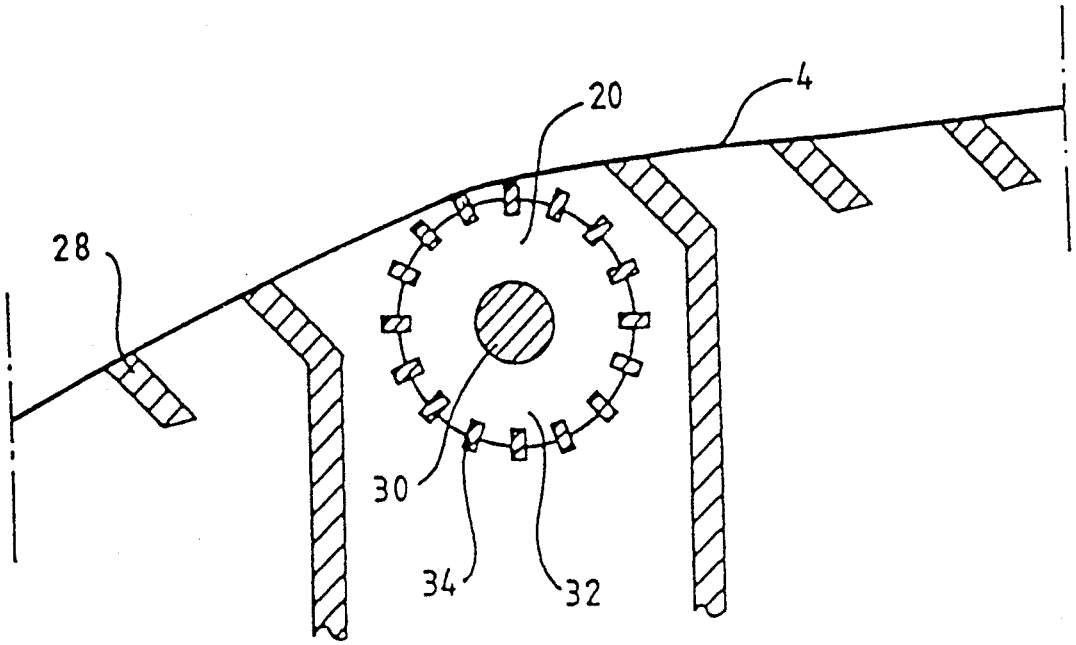
FIG. 2 is an enlarged fragmentary elevational sectional view showing one of the drainage zones shown in FIG. 1.
Figure 3:
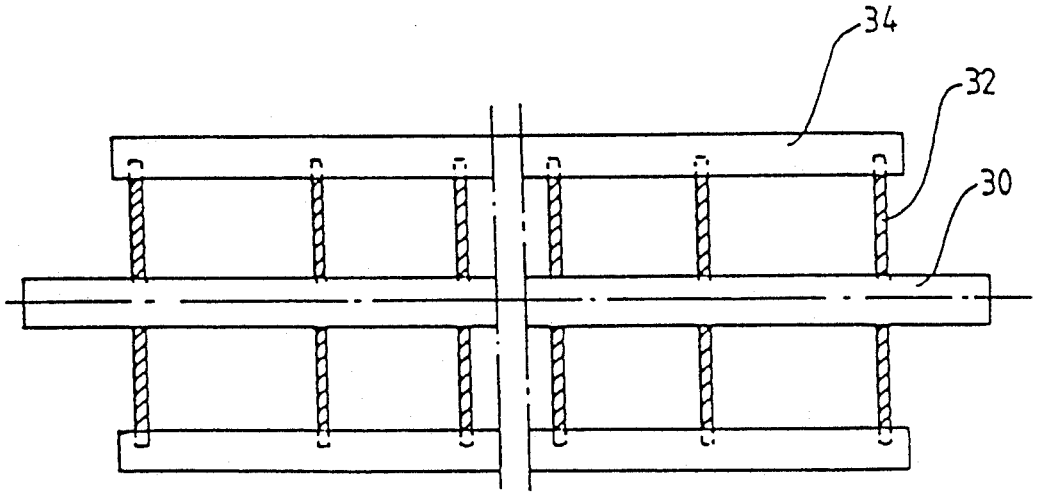
FIG. 3 is a longitudinal section of the drainage roll shown in FIG. 2.

The drainage roll 20 is shown more in detail in FIGS. 2 and 3. The roll comprises a rotatable shaft 30 on which a plurality of discs 32 is disposed a distance apart from each other. A plurality of longitudinal rods 34 is attached to the rims of the discs spaced apart from each other so as to form a roll of open structure having a very low flow resistance. The roll has no drive of its own, i.e. it is driven by the forming wire itself and therefore has a speed virtually equivalent to that of the wire. In operation, the roll allows the wire to move towards the roll center every time the gap between a successive pair of rods passes under the wire, which causes oscillation of the wire, whereby the formation and dewatering of the fiber layers on the wire are positively influenced. The longitudinal rods 34 prefereably consist of flat bars.

Under the wire, there is a plurality of vacuum or suction drainage boxes 26 in each of which a plurality of drainage elements 28 such as deflector or hydrofoil or foil blades may be disposed. The drainage rolls 20 are also disposed in the drainage boxes.

The filter paper is built up of a plurality of layers. Each layer is superimposed on the layer formed in the preceding forming zone. As the drainage resistance of the fiber mat increases from one forming zone to the next, the dewatering pressure has to increase correspondingly. However, as the inclination of the wire decreases in the traveling direction of the wire, the length of the forming zones increase towards the end of the inclined wire portion. This means that the available drainage time increases which compensates for the increasing drainage resistance.

Figure 4:
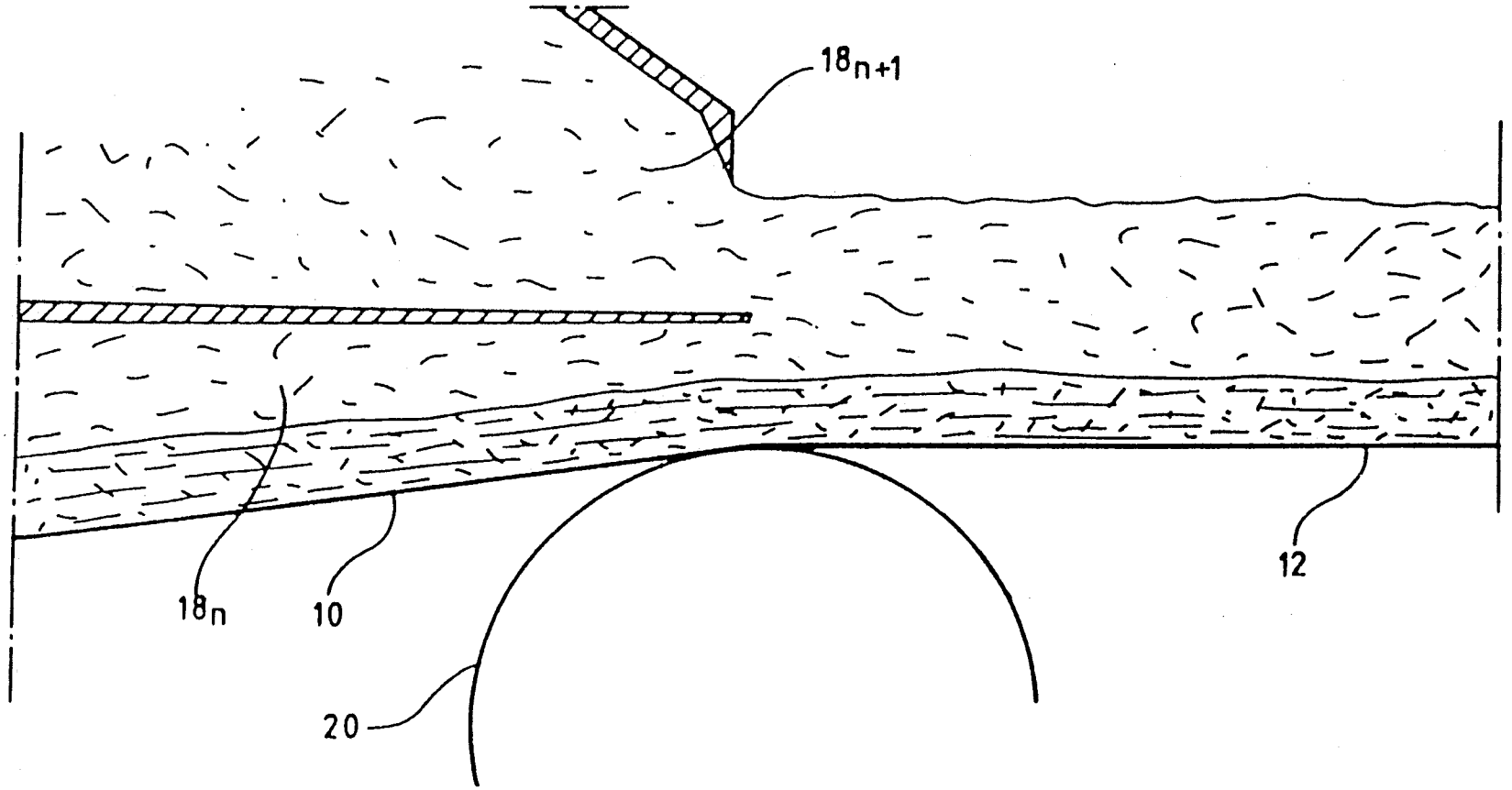
FIG. 4 is an enlarged fragmentary elevational sectional view showing the transition region between the inclined wire and the horizontal wire portion.

At least a substantial part of the sheet will be formed on the inclined wire. The uppermost layer, which has the highest density and which normally is on the exit side of the filter paper, is formed on the horizontal wire from stock delivered by a flow channel $\mathbf{18}_{n+1}$ disposed on top of flow channel $\mathbf{18}_n$. The stock for the last layer, as well as for all the other layers, is deposited on a sheet which is not yet fully formed, as shown in FIG. 4, so that there is caused an intermingling of the fibers at the interface. In the transition region between the inclined wire 10 and the horizontal wire 12 there is still fiber suspension from the last inclined formation zone $\mathbf{22}_n$.

We claim:

1. In a paper machine having a moving forming fabric, a turbulence roll for generating high-frequency vibrations of the moving forming fabric and having a surface with a plurality of lengthwise extending gaps extending the entire length of the roll, said roll comprising:

a shaft (30) having an axis;

a plurality of spaced discs (32) having rims and being mounted on said shaft; and a plurality of means for generating the high-frequency vibrations of the moving forming fabric, said means comprising a plurality of spaced axially extending rods (34) attached to and extending outwards from said rims of said discs, the spacing between said rods forming the plurality of the lengthwise extending gaps.

2. The turbulence roll according to claim 1, wherein said rods (34) are flat bars.

3. A method of using a turbulence roll for generating high-frequency vibrations of a moving forming wire in a paper former having an inclined wire portion and a horizontal or substantially horizontal wire portion, the roll having a surface with a plurality of lengthwise extending gaps extending the entire length of the roll and further comprising a shaft having an axis, a plurality of spaced discs having rims and being mounted on said shaft, and a plurality of means for generating the high-frequency vibrations of the moving forming wire, said means comprising a plurality of spaced axially extending rods attached to and extending outwards from the rims of the discs, the spacing between the rods forming the plurality of the lengthwise extending gaps, said method comprising: utilizing said turbulence roll under the forming wire as a supporting roll between two flat sections forming an angle with each other in the inclined wire portion.

* * * * *